United States Patent [19]

Rommerdale

[11] Patent Number: 5,052,416

[45] Date of Patent: Oct. 1, 1991

[54] CONTROL IMPROVING COMPONENTS FOR FINGERNAIL CLIPPERS

[75] Inventor: Eric Rommerdale, Brandon, Miss.

[73] Assignee: The W.E. Bassett Company, Shelton, Conn.

[21] Appl. No.: 413,224

[22] Filed: Sep. 27, 1989

[51] Int. Cl.[5] ..... A45D 29/00

[52] U.S. Cl. ..... 132/75.5; 132/73; 30/28

[58] Field of Search ..... 132/73, 73.5, 75.3, 132/75.4, 75.5, 75.6, 76.4; 30/26, 28, 29; 294/99.2; 606/210, 211; 433/159; 16/114 R

[56] References Cited

U.S. PATENT DOCUMENTS

| | | | |
|---|---|---|---|
| 702,516 | 6/1902 | Wilcox | 132/75.5 |
| 1,375,167 | 4/1921 | New | 132/75.6 |
| 1,707,879 | 4/1929 | Schwartzman | 132/75.6 |
| 1,915,154 | 6/1933 | De Schebeko | 294/99.2 |
| 2,117,053 | 5/1938 | Bickley | 132/76.4 |
| 2,157,226 | 5/1939 | Betz | 294/99.2 |
| 2,411,825 | 11/1946 | Ferguson | 294/99.2 |
| 2,739,379 | 3/1956 | Bassett | 30/28 |
| 3,180,025 | 4/1965 | Tsunemi | 132/75.4 |
| 3,744,131 | 7/1973 | Manes | 30/28 |
| 3,832,771 | 9/1974 | Morgan | 30/28 |
| 3,855,698 | 12/1974 | Crosby | 30/28 |
| 3,903,596 | 9/1975 | Crosby | 30/29 |
| 4,017,923 | 4/1977 | Schentz | 132/75.4 |
| 4,150,481 | 4/1979 | Min | 132/73 |
| 4,176,449 | 12/1979 | Lee et al. | 30/28 |
| 4,640,011 | 2/1987 | Gamble | 132/73.5 |
| 4,727,876 | 3/1988 | Porat et al. | 433/159 |
| 4,776,090 | 10/1988 | Grassi | 132/73 |

FOREIGN PATENT DOCUMENTS

| | | | |
|---|---|---|---|
| 2809220 | 9/1979 | Fed. Rep. of Germany | 132/75.4 |
| 1391867 | 4/1988 | U.S.S.R. | 294/99.2 |
| 0009580 | of 1909 | United Kingdom | 294/99.2 |

*Primary Examiner*—John J. Wilson
*Assistant Examiner*—Frank A. LaViola
*Attorney, Agent, or Firm*—Melvin I. Stoltz

[57] ABSTRACT

By providing separate, easily mountable members which incorporate finger/thumb receiving and holding zones constructed for use and access by individuals with reduced or impaired manual dexterity, a control improving and enhancing system is achieved which is mountable directly to conventional implements, such as manicure implements. Preferably, each control improving and enhancing system is constructed for being quickly and easily securely mounted to existing implements and may be removable therefrom for use on other implements. In addition, each control improving and enhancing system is constructed with enlarged, specially constructed, readily accessible, easily employable finger/thumb receiving and supporting zones which are positioned to assure complete operational control of the implement, thereby enabling individuals with reduced or impaired manual dexterity, or with varying stages of joint diseases, such as arthritis, to naturally and confidently use the implements.

12 Claims, 4 Drawing Sheets

FIG. 7
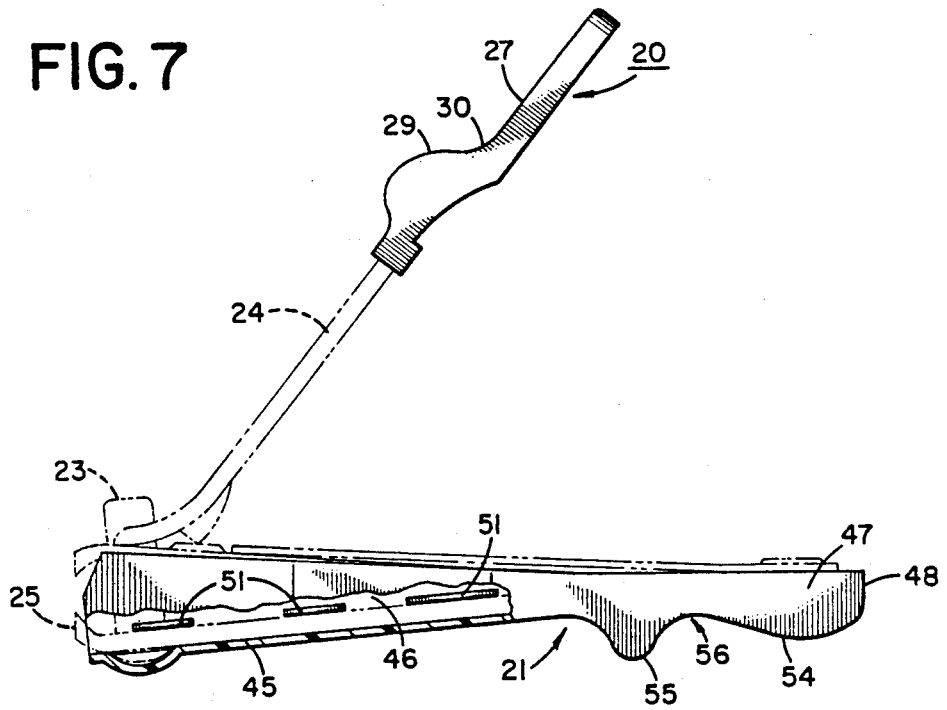
FIG. 8
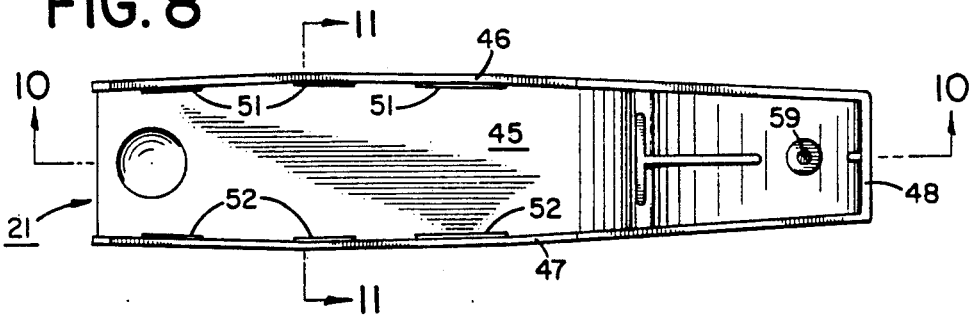
FIG. 9
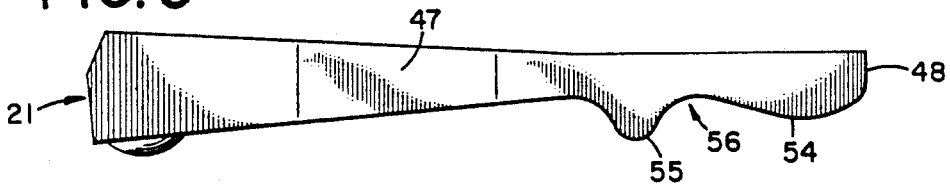
FIG. 10
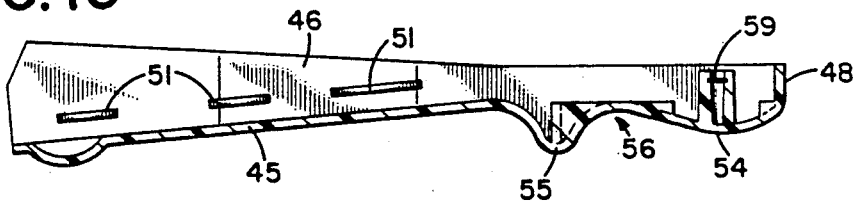
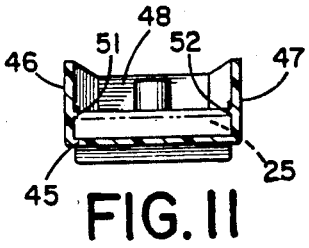
FIG. 11
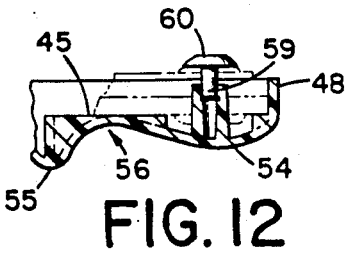
FIG. 12

CONTROL IMPROVING COMPONENTS FOR FINGERNAIL CLIPPERS

TECHNICAL FIELD

This invention relates to manicure implements and more particularly to components mountable to conventional manicure implements for improving the ease with which the implement may be handled and controlled during use.

BACKGROUND ART

Manicure implements such as fingernail clippers, toenail clippers, tweezers and emery boards are extremely popular and widely used to improve one's hygiene and visual appearance. However, many individuals who have been using such manicure implements for many years find it increasingly difficult to manipulate these small devices, particularly as these individuals age or lose manual dexterity.

In addition, many individuals suffer from arthritis or other forms of joint disease, which makes it extremely difficult to hold and use small implements. Although these individuals find it difficult to hold and employ these manicure devices, these individuals desire to use these devices and attempt to do so, with varying degrees of success.

In view of this problem, the manicure implements have been constructed in a variety of alternate configurations in an attempt to improve the handling characteristics of these implements. However, either due to manufacturing difficulties or construction expenses, these prior art systems have been incapable of satisfying consumers' desire to have manicure implements which are easily handled, regardless of impaired dexterity.

One of the principal drawbacks encountered with prior art constructions is the inability to develop a usable product which is not too costly to produce. Typically, the prior art configurations that have been developed suffer from the inability to be competitively manufactured. Consequently, these implements cannot be sold at a reasonable price. Furthermore, many of these prior art constructions fail to enhance the operability of the manicure implements and, instead, merely create a more cumbersome, difficult-to-use product.

Consequently, it is a principal object of the present invention to provide manicure implements which are easily employed by all individuals, regardless of the level of dexterity the individuals may have and, more particularly, easy to use by individuals with reduced manual dexterity.

Another object of the present invention is to provide manicure implements having the characteristic features described above which are comparatively simple in construction and manufacture.

Another object of the present invention is to provide manicure implements having the characteristic features described above which can be sold at a competitive price with the enhanced handling characteristics included therewith.

Another object of the present invention is to provide manicure implements having the characteristic features described above which are comfortable to hold and use by all individuals, particularly individuals having very limited finger manipulation capabilities.

Other and more specific objects will in part be obvious and will in part appear hereinafter.

SUMMARY OF THE INVENTION

By employing the teaching of the present invention, the drawbacks, difficulties and failings found in the prior art have been eliminated. In particular, it has been found that by constructing control enhancing systems or components which are quickly and easily mounted to existing manicure implements, the control and handling capabilities of the implements are substantially improved, enabling all individuals to securely, comfortably and naturally hold and employ implements which some individuals were previously unable to use. Furthermore, by using the present invention, the implements are imparted with enhanced handling capabilities without affecting the production of the implements themselves. Consequently, manicure implements for which control improvement and enhancement is desired are manufactured by conventional techniques and are improved by subsequently mounting the control enhancing systems of the present invention directly to the conventional manicure implements.

If desired, the control enhancing system of the present invention can be either securely affixed to conventional manicure implements or constructed for being removably mounted to conventional manicure implements. Regardless of whether removability or secure affixation is preferred, the control enhancing system of the present invention is constructed in substantially the same way for being quickly and easily securely mounted to the particular manicure implement. In this way, uniform construction techniques are attained and manufacturing costs are reduced.

In the present invention, the control enhancing system is constructed for being rapidly securable to a particular manicure implement in a manner which requires no sophisticated tools or equipment. As a result, by constructing the control enhancing systems of the present invention in a manner which allows rapid, easy mountability of the system to the particular manicure implement, the use of the control enhancing system can be quickly and easily attained by the individual as well as the manufacturer.

In addition to direct, easy mountability to existing manicure implements, each of the control enhancing systems of the present invention are constructed to provide all individuals with substantially improved control of the manicure implement. In particular, individuals having reduced or impaired manual dexterity are now able to use implements which were previously difficult or impossible to use. However, the control enhancing systems of the present invention are specifically constructed to enable all individuals, with various degrees of manual dexterity or varying stages of joint diseases, such as arthritis, to easily hold and use the manicure implements with complete control and confidence.

In order to provide enhanced control and improved use and implementation of the manicure devices, each control enhancing system of the present invention incorporates finger or thumb engaging zones specifically constructed for receiving thumbs, fingers, or hand or palm portions of the individual in a comfortable, natural manner, which allows the individual to employ the manicure implement with ease and convenience.

As will be readily understood by one of ordinary skill in this art, the control enhancing system of the present invention is usable on all manicure implements, as well as on all other similar hand manipulated devices which individuals with reduced or impaired manual dexterity traditionally experience difficulties. However, for the purpose of the present disclosure and, without in any way intending to be limited to the specific disclosure, the following drawings and detailed disclosure exemplifies the use of the present invention in connection with toenail and fingernail clippers, tweezers and emery boards. However, the present invention is considered to extend beyond these specific embodiments and no intent to limit the present invention to these specific embodiments is contemplated.

The invention accordingly comprises an article of manufacture, possessing the features, properties and relation of elements which will be exemplified in the articles hereinafter described and the scope of the invention will be indicated in the claims.

THE DRAWINGS

For a fuller understanding of the nature and objects of the present invention, reference should be had to the following detailed description taken in connection with the accompanying drawings, in which:

FIG. 7 is a side elevational view, partially in cross-section and partially broken away, of the control enhancing system of the present invention mounted to a nail clipper depicted in the open configuration, ready for use;

FIG. 8 is a top plan view of the base engaging member of the control enhancing system depicted in FIGS. 1 and 7;

FIG. 9 is a side elevational view of the base engaging member;

FIG. 10 is a cross-sectional side elevational view of the base engaging member taken along line 10—10 of FIG. 8;

FIG. 11 is a cross-sectional front elevational view of the base engaging member taken along line 11—11 of FIG. 8;

FIG. 12 is a cross-sectional side elevational view, partially broken away, showing the distal end of the base engaging member securely affixed to the base of the nail clipper;

DETAILED DESCRIPTION

In the following drawings, specific configurations of the control-improving systems and components of the present invention for manicure implements are specifically detailed and disclosed. As will be apparent from this disclosure, the teaching of the present invention can be employed in numerous other manicure implements or manually controlled products by creating similar control-improving systems therefor. Consequently, although control improving systems for nail clippers, tweezers and emery boards are specifically detailed herein, the present invention is not intended to be limited to these manicure implements only, and any other manicure implement or similar product to which a control-improving system is mounted employing the teaching of this invention is intended to be within the scope of the present invention.

Figure 1:
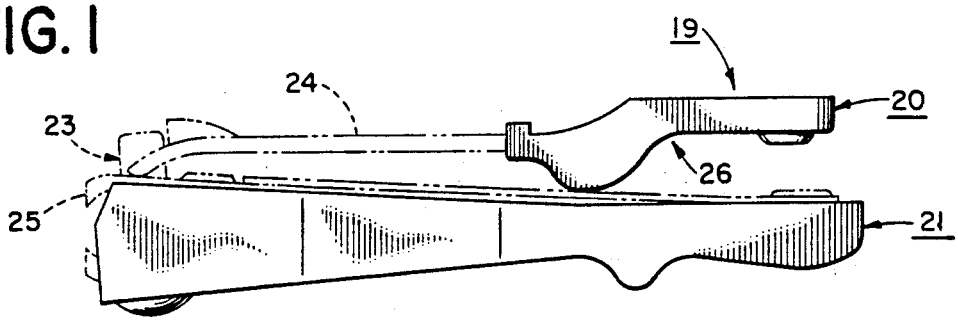
FIG. 1 is a side elevational view of the control enhancing system of the present invention mounted to a nail clipper depicted in the closed position.
Figure 2:
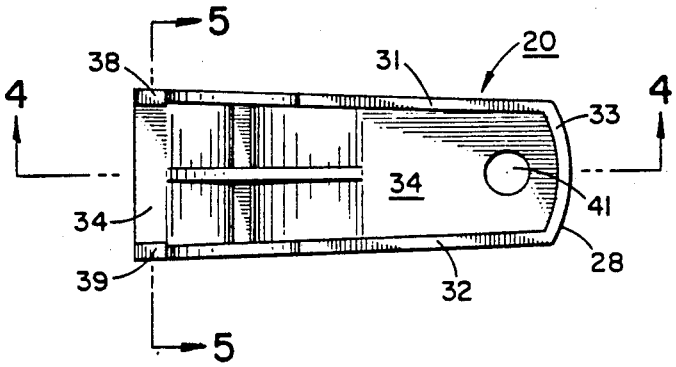
FIG. 2 is a top plan view of the lever engaging member of the control enhancing system depicted in FIG. 1.

In FIG. 1, control-improving system 19 of the present invention is shown mounted to a typical nail clipper 23. In this embodiment, control-improving system 19 comprises two independent components, a lever-engaging member 20, and a base-engaging member 21.

In FIG. 1, nail clipper 23 is shown in its closed position, while FIG. 7 depicts nail clipper 23 in its open, ready-to-use, position. Furthermore, nail clipper 23 is depicted as a toenail clipper. However, the following disclosure applies with equal force and efficacy to fingernail clippers, as well as all clippers of similar construction.

Lever-engaging member 20 is mounted to the lever arm 24 of nail clipper 23 while base-engaging member 21 is mounted to base 25 of nail clipper 23. By mounting control improving system 19 to any typical nail clipper, the resulting nail clipper is easily used by individuals with impaired dexterity, since members 20 and 21 enable the user to easily grip, hold, handle and manipulate the nail clipper, even though conventional nail clippers may not be used by the individual effectively.

As is more fully detailed below, members 20 and 21 of control-improving system 19 incorporate readily accessible finger or thumb receiving zones constructed to provide natural, comfortable, readily accessible holding zones enabling the user to quickly and easily securely grip and firmly hold the control improving members and employ the nail clippers in a natural, comfortable manner. However, before detailing the finger-receiving and engaging zones of members 20 and 21, the construction and mounting of control improving members 20 and 21 to nail clipper 23 will be described.

In FIGS. 2–5, the construction of lever-engaging member 20 for mounting to lever arm 24 of clipper 23 is shown in detail. By referring to these Figures and the following detailed discussion, the construction of lever-engaging member 20 can best be understood.

Figure 3:
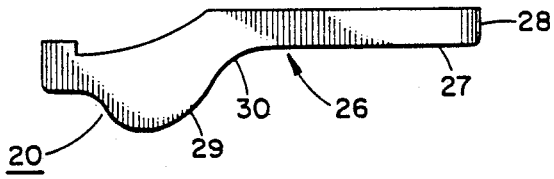
FIG. 3 is a side elevational view of the lever engaging member.
Figure 4:
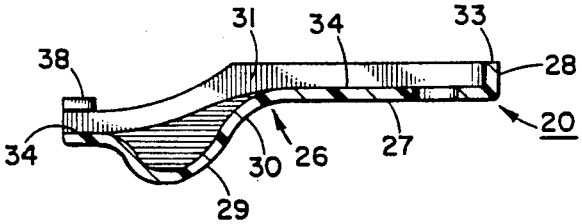
FIG. 4 is a cross-sectional side elevational view of the lever engaging member taken along line 4—4 of FIG. 2.

In its preferred embodiment, lever-engaging member 20 comprises a single component having a generally rectangular shape and incorporating a distal end 28, and a base 34 having an outer surface comprising a finger or thumb receiving zone 26 formed thereon. Preferably, finger/thumb receiving zone 26 comprises a substantially smooth surface formed by a substantially flat thumb/finger support surface 27, thumb/finger abutment surface 29, and concave, intermediate, interconnecting surface 30. As best seen in FIGS. 3 and 4, surfaces 27, 29 and 30 preferably comprise a smooth, substantially continuous blended construction thereby forming a comfortable thumb/finger receiving and holding zone 26.

Figure 5:
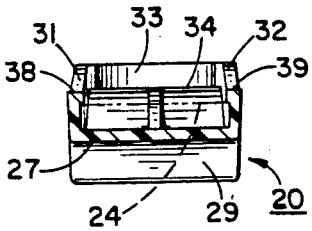
FIG. 5 is a cross-sectional front elevational view of the lever engaging member taken along line 5—5 of FIG. 2.

As shown in FIG. 5, finger/thumb receiving zone 26 extends the entire width of lever-engaging member 20, providing a wide, comfortable thumb receiving surface on which the user easily and conveniently positions either his thumb or finger. In addition to providing a readily accessible support surface, receiving zone 26 also provides positive assurance that unwanted forward movement of the thumb or finger is prevented. This is provided by the secure, contacting engagement of the thumb or finger with upstanding, convexly curved surface 29.

In order to assure that lever-engaging member 20 is quickly and easily securely mountable to lever arm 24 of nail clipper 23, lever-engaging member 20 incorporates upstanding side walls 31 and 32 and an upstanding distal end wall 33. Walls 31, 32 and 33 are all blended together to form a substantially continuous upstanding wall configuration. Furthermore, walls 31, 32 and 33 all extend from inside base 34 of lever-engaging member 20 to provide a position holding and securing surface for lever-engaging member 20 when member 20 is mounted to lever arm 24 of nail clipper 23.

In the preferred embodiment, walls 31 and 32 are spaced apart a distance substantially equal to the width of lever arm 24 of nail clipper 23 with a tapered configuration conforming to the configuration of lever arm 24. In addition, wall 33 extends between and interconnects walls 31 and 32 with an overall shape conforming to the terminating end of lever arm 24. In this way, walls 31, 32 and 33 cooperate to peripherally surround and abuttingly engage the terminating edge of lever arm 24, allowing lever-engaging member 20 to be securely affixed to the end of lever arm 24 with any side-to-side or forward movement being eliminated thereby.

Finally, in order to securely lockingly engage lever-engaging member 20 to lever arm 24, the proximal end of member 20 incorporates locking flanges 38 and 39. Locking flange 38 extends from upstanding side wall 31, while locking flange 39 extends from side wall 32. In addition, flanges 38 and 39 are spaced above inside surface of base 34 of lever-engaging member 20 a distance substantially equal to the thickness of lever arm 24 of nail clipper 23. In this way, when lever-engaging member 20 is mounted to lever arm 24 of nail clipper 23, with walls 31, 32 and 33 peripherally surrounding and positioning lever-engaging member 20 to the distal end of lever arm 24, locking flanges 38 and 39, in conjunction with the wall portions thereof, peripherally surround the sides of lever arm 24 and lockingly engage lever arm 24. In this way, lever-engaging member 20 is securely affixed in the precisely desired position to lever arm 24.

As is apparent from the preceding disclosure, lever-engaging member 20 can be quickly and easily removed from lever arm 24 with the same speed and ease as required for mounting member 20 to lever arm 24. In order to dislodge or remove member 20 from lever arm 24, locking flanges 38 and 39 can be bent outwardly, thereby disengaging the locked position and allowing member 20 to be removed from lever arm 24, whenever such removal is desired.

Figure 6:
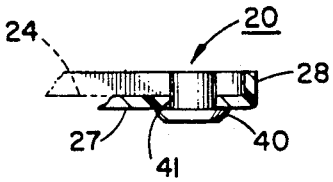
FIG. 6 is a cross-sectional side elevational view, partially broken away, of the distal end of the lever engaging member securely affixed to the lever arm.

In an alternate embodiment, lever-engaging member 20 is securely affixed permanently to lever arm 24. In this embodiment, member 20 is mounted to lever arm 24 in the manner described above. Then, if secure mounted engagement of member 20 is desired, a locking pin 40, as shown in FIG. 6, is employed.

Typically, lever arm 24 incorporates a through hole formed in its distal end. As a result, member 20 preferably incorporates a through hole 41 positioned for juxtaposed axial alignment with the through hole of lever arm 24. Once lever-engaging member 20 is mounted in position, hole 41 is axially aligned with the hole of lever arm 24. Then, to securely affix member 20 to arm 24, locking pin 40 is inserted through the axially aligned holes and then affixed in this position, in the conventional manner, securing member 20 to lever arm 24.

As shown in FIGS. 1 and 7, base-engaging member 21 is mounted directly to base 25 of nail clipper 23 in order to impart the desired improved control and handling characteristics to the base of nail clipper 23. In addition, in the preferred embodiment, base-engaging member 21 is constructed to completely enclose base 25 of nail clipper 23, thereby serving as a catcher for nail clippings in addition to providing improved control and handling characteristics to the nail clipper. If desired, however, the nail clipping catcher portion can be eliminated and only the control improving portion of member 21 may be employed.

As best seen in FIGS. 7–12, base-engaging member 21 of control improving system 19 of the present invention comprises a substantially elongated rectangular shape having a base 45 with upstanding, elongated side wall portions 46 and 47, and upstanding wall portion 48 forming its terminating distal end. In addition, in the preferred embodiment, wall portions 46, 47 and 48 are all interconnected to form a substantially continuous upstanding wall peripherally surrounding three of the four sides of base 45 of member 21.

Upstanding side wall 46 incorporates a plurality of inwardly extending flanges 51 formed along the inside surface thereof, while upstanding side wall 47 also incorporates a plurality of inwardly extending flanges 52 extending along the inside surface thereof in juxtaposed, spaced, cooperating relationship with flanges 51 of wall 46. As best seen in FIGS. 7, 10 and 11, flanges 51 of wall portion 46 and flanges 52 of wall portion 47 are spaced above the inside surface of base 45 a distance slightly greater than the thickness of the lower plate of base 25 of nail clipper 23.

In this way, walls 46 and 47 of base-engaging member 21 substantially enclose the sides of base 25 of nail clipper 23, with flanges 51 and 52 lockingly securing member 21 to nail clipper 23 by being positioned in overlying, locking engagement with the upper surface of the lower plate of base 25. In this way, member 21 is quickly and easily securely mounted to nail clipper 23 with side walls 46 and 47 closing the open sides of nail clipper 23.

By employing this construction, as discussed above, base-engaging member 21 also catches and retains all of the clipped nails therein. In addition, whenever one desires to dispose the retained nail clippings, base-engaging member 21 is easily dislodged from base 25 of nail clipper 23 by forcing side walls 46 and 47 away from base 25 of nail clipper 23 a sufficient distance to disengage flanges 51 and 52 from the lower plate of base 25. Once flanges 51 and 52 have been disengaged, member 21 can be removed and the clippings contained therein discarded. Alternatively, the nail clippings can be removed from base-engaging member 21 by shaking nail clipper 23 over an appropriate receptacle and allowing the clippings to exit the proximal end of base 23 through the open jaws thereof by gravity.

In order to provide the desired control and handling characteristics to nail clipper 23, base-engaging member 21 also incorporates a substantially "S"-shaped, double curved outer surface 54. Preferably, "S"-shaped double curved outer surface 54 is formed as the outer surface of base 45 of member 21 near the distal end thereof. In addition, double curved, S-shaped surface 54 commences at the distal end with upstanding wall 48 and terminates inwardly therefrom along base 45 with upstanding extension stop abutment 55.

By employing this configuration, it has been found that double curved surface 54, in conjunction with stop abutment 55, provides a readily accessible, convenient holding zone 56 for receiving the particular desired portion of one's hand to be used to operate the nail clipper. Typically, one or more of the user's fingers would be nested directly adjacent stop abutment 55 within one of the curves of double curve surface 54.

Some individuals employ their fingers, thumb or portions of their hand or palm to control and operate nail clipper 23. However, regardless of which portion of the hand is employed in using nail clipper 23, it has been found that "S"-shaped double curved surface 54 and stop abutment 55 provide all individuals with a secure, convenient, readily accessible zone by which any individual having limited manual dexterity can quickly and easily hold and control base 25 of nail clipper 23 in order to achieve the desired nail clipping operation.

In the preferred embodiment, curved surface 54 and enlarged stop abutment 55 comprise smooth, substantially continuous rounded surfaces to provide comfort and convenience to the user. If desired, other shapes or surface configurations could be employed, without departing from the scope of the invention. However, it has been found that a smooth, curved configuration as provided by zone 56 provides the optimum comfort and convenience to the user, while providing the desired control and handling characteristics to nail clipper 23.

Although upstanding walls 46, 47 and 48 in combination with locking flanges 51 and 52 provide the desired securely mounted interengagement of base-engaging member 21 with nail clipper 23, member 21 may also incorporate, if desired, upstanding post 59 which matingly engages in the through hole typically formed in the distal end of base 25 of nail clipper 23. In addition, upstanding post 59 also incorporates a pin receiving cavity formed therein for receiving locking pin 60, if secure affixation of control improving member 21 to nail clipper 23 is desired.

As is apparent from the foregoing detailed disclosure, lever-engaging member 20 and base-engaging member 21 are quickly and easily either removably mounted to nail clipper 23 or permanently affixed to nail clipper 23 in order to substantially enhance and improve the control and handling characteristics of conventional nail clippers. By mounting control improving system 19 to nail clipper 23, a conventional nail clipper, whether it be a toenail clipper or a fingernail clipper is immediately converted into a manicure implement which can be easily held and operated with convenience and ease by individuals having complete manual dexterity as well as by individuals having limited manual dexterity. As a result, such manicure implements as toenail clippers and fingernail clippers, which previously have been unusable by older individuals or individuals with varying stages of arthritis or other joint diseases, can now be used by these individuals with the knowledge and assurance that they can easily operate and completely control the nail clippers. In this way, use of nail clippers, which has previously been denied such individuals, can now be fully and completely employed by them with confidence and ease.

Another manicure implement which individuals having reduced manual dexterity desire to employ is tweezers. However, due to the small elongated arm members forming most conventional tweezers, these individuals have experienced substantial difficulty in holding and controlling the use of conventional tweezers. In particular, these tweezers tend to roll or twist in the user's hand, thereby rendering the tweezers useless, since the operating jaws cannot be opened and closed at precisely desired locations.

Figure 13:
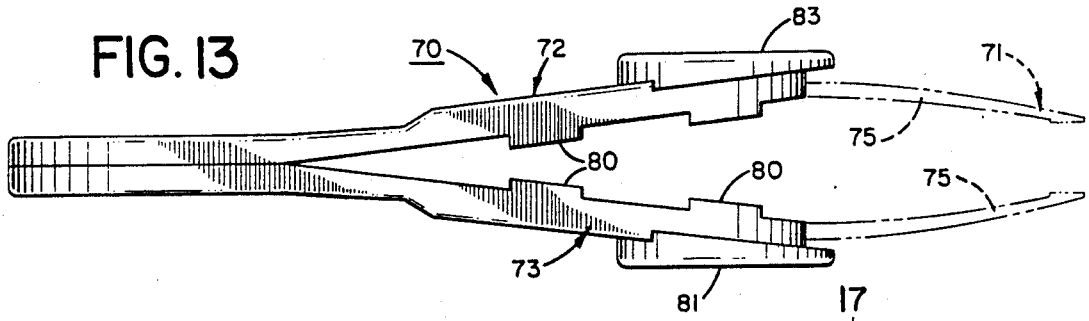
FIG. 13 is a side elevational view of an alternate embodiment of the control enhancing system of the present invention shown mounted to a pair of tweezers.
Figure 14:
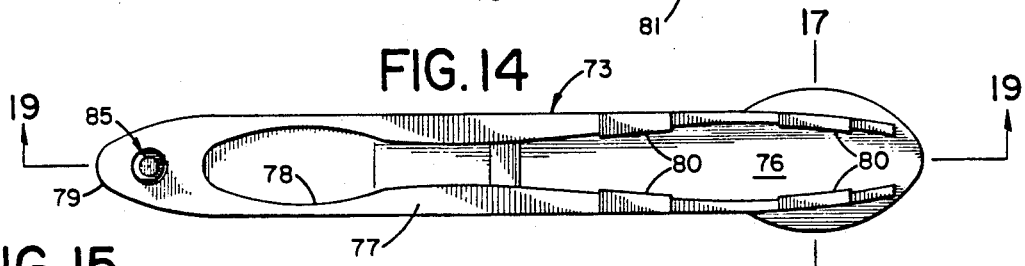
FIG. 14 is a top plan view of the lower tweezer-arm engaging member of the control enhancing system of FIG. 13.
Figure 15:
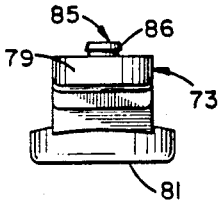
FIG. 15 is a rear end view of the lower tweezer-arm engaging member.
Figure 16:
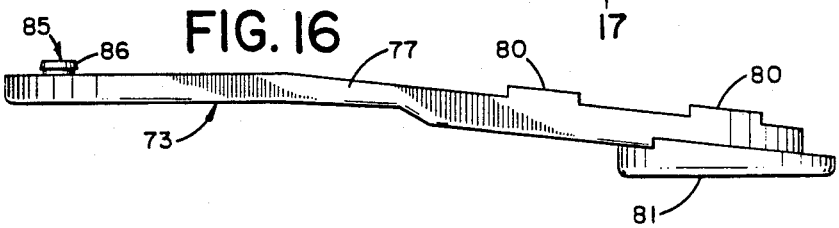
FIG. 16 is a side elevational view of the lower tweezer-arm engaging member.

In order to eliminate this difficulty and attain a tweezers construction which can be employed by individuals with limited or reduced manual dexterity, control improving assembly 70 was developed. As shown in FIG. 13, control improving assembly 70 is mountable to conventional tweezers 71 and comprises substantially similar elongated tweezer-arm engaging members 72 and 73, each of which are mounted to one elongated arm 75 of tweezers 71. By referring to FIGS. 13-20 along with the following detailed disclosure, the precise construction and operation of control improving assembly 70 can best be understood.

As is more fully detailed below, tweezer-arm engaging members 72 and 73 are substantially identical in construction, except for the interlocking system formed at the distal end of members 72 and 73. Consequently, except for specific detailed discussions concerning this interlocking construction, all references to the construction of either tweezer-arm engaging member 72 or 73 is intended to apply equally to both components.

In addition, in FIGS. 14–19, tweezer-arm engaging component 73 has been depicted and is employed in the following detailed discussion. However, all references to the construction and operation of tweezer-arm engaging component 73 in the following detailed discussion, except where noted, is intended to apply with equal force and effect as a detailed discussion of the construction of tweezer-arm engaging member 72.

As shown in FIGS. 14–19, tweezer-arm engaging member 73 comprises a substantially elongated generally rectangular shape defined by base 76 and upstanding wall 77 which peripherally surrounds base 76 and forms the terminating edges of tweezer-arm engaging member 73 on three of its four sides. As clearly shown in FIG. 14, upstanding, peripherally surrounding wall 77 comprises an irregularly shaped continuous inside surface 78, which is constructed to conform precisely with the shape of the outside edge of the tweezer arm 75 to which tweezer-arm engaging member 73 is to be mounted. In this way, one arm 75 of tweezers 71 nests directly within upstanding wall 77 with surface 78 surroundingly embracing arm 75 of tweezers 71 to assure secure, slip-free attachment thereto.

Figure 17:
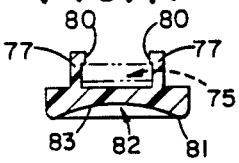
FIG. 17 is a cross-sectional front elevational view of the lower tweezer-arm engaging member taken along line 17—17 of FIG. 14.
Figure 19:
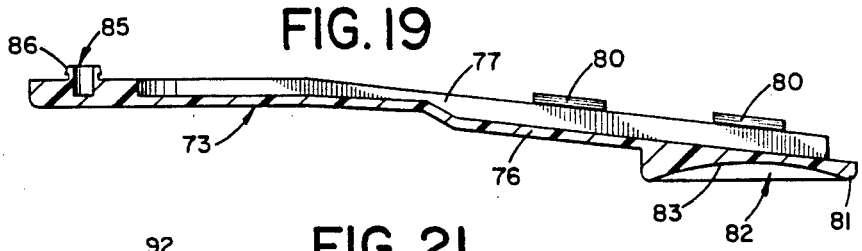
FIG. 19 is a cross-sectional side elevational view of the lower tweezer-arm engaging member taken along line 19—19 of FIG. 14.

In addition, in order to assure secure mounted locking engagement of tweezer-arm engaging member 73 to arm 75 of tweezers 71, tweezer-arm engaging member 73 incorporates a plurality of inwardly extending flanges 8 formed on upstanding wall 77. As best seen in FIGS. 17 and 19, inwardly extending flanges 80 are spaced above base 76 a distance substantially equal to the thickness of arm 75 of tweezers 71. In this way, tweezer-arm engaging member 73 is quickly and easily securely fastened to arm 75 of tweezers 71 by positioning arm 75 of tweezers 71 in the accommodating recess formed by peripherally surrounding wall 77, with flanges 80 cooperating with wall 77 to surround arm 75 of tweezers 71 and securely lock tweezer-arm engaging member 73 to tweezers arm 75.

When securely mounted in position, tweezer-arm engaging member 72 and tweezer-arm engaging member 73 are maintained securely affixed to arms 75, 75 of tweezers 71, as long as desired by the user. However, if disengagement of control enhancing assembly 70 from tweezers 71 is desired, arm 75 of tweezers 71 can be easily disconnected from locked engagement with flanges 80 of tweezer-arm engaging members 72 and 73, thereby effectuating removal of tweezers 71 therefrom. Of course, whenever mounted interconnection of control enhancing assembly 70 with tweezers 71 is again desired, tweezers 71 can be reconnected to control enhancing assembly 70 in the manner detailed above.

In order to provide the desired improved control and handling characteristics to the user of tweezers 71, tweezer-arm engaging members 72 and 73 of control enhancing assembly 70 each incorporate an enlarged, readily accessible, finger/thumb receiving and holding platform 81 formed as a part thereof. Preferably, platform 81 is positioned on tweezer-arm engaging member 72 and 73 to be located substantially midway along arms 75, 75 of tweezers 71. In this way, finger/thumb receiving and holding platforms 81, 81 of members 72 and 73 are quickly and easily accessed by the user, providing the user with complete control and handling capabilities over tweezers 71.

Figure 18:
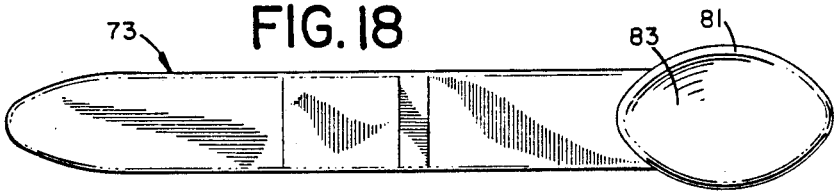
FIG. 18 is a bottom plan view of the lower tweezer-arm engaging member.

As best seen in FIGS. 17–19, finger/thumb receiving and holding platform 81 preferably comprises a substantially enlarged finger engaging zone 82 formed by substantially concave surface 83. In this way, individuals with reduced manual dexterity can quickly and easily access finger engaging zone 82 regardless of impaired capabilities and be able to completely control the movement of arms 75, 75 of tweezers 71. As a result, individuals who previously were unable to employ tweezers are now capable of completely controlling and handling the movement of arms 75, 75 of tweezers 71 without incurring any difficulty.

In order to securely affix tweezer-arm engaging member 73 with tweezer-arm engaging member 72, tweezer-arm engaging member 73 incorporates an upstanding locking post 85 formed near the distal end 79 thereof. As clearly shown in FIGS. 15, 16, and 19, locking post 85 preferably incorporates a radial, outwardly extending flange 86 which peripherally surrounds the upper portion of post 85.

Figure 20:
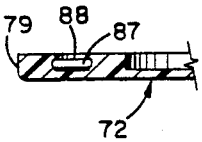
FIG. 20 is a cross-sectional side elevational view of the distal end of the upper tweezer-arm engaging member of the control enhancing system of FIG. 13.

As clearly shown in FIG. 20, distal end 79 of tweezer-arm engaging member 72 incorporates a post receiving cavity 88 with an enlarged flange receiving relief 87 formed near the base of cavity 88. By employing this construction, tweezer-arm engaging members 72 and 73 are quickly and easily securely affixed to each other at their respective distal ends by positioning post 85 in juxtaposed, axial alignment with cavity 88, and then forcing post 85 into locked engagement within cavity 88.

Once forced into secure locked interengagement with each other, flange 86 of pin 85 is securely locked within recess 87 of cavity 88, thereby maintaining tweezer-arm engaging members 72 and 73 in secure, aligned, locked interengagement with each other. In this way, trouble-free continuous operation is assured, and the user attains the desired enhanced control and handling capabilities over tweezers 71.

Figure 21:
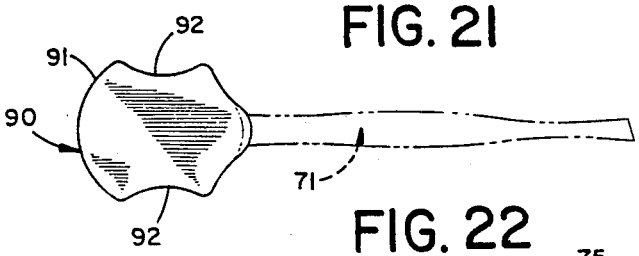
FIG. 21 is a top plan view of another alternate embodiment of the control enhancing system of the present invention.
Figure 22:
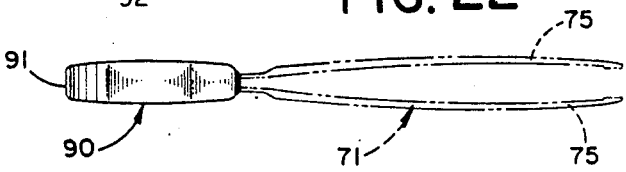
FIG. 22 is a side elevational view of the control enhancing system of FIG. 21.

In FIGS. 21 and 22, tweezer stabilizing component 90 is shown. In this embodiment, tweezer stabilizing member 90 is affixed to the distal end of tweezers 71 in order to provide means by which the user can securely and comfortably control the distal end of the tweezers, thereby providing further enhanced stability of the tweezers during use.

Stabilizing member 90 may be formed from either a single component which is axially secured to the distal end of tweezers 71, or may be formed in two components which lockingly embrace the distal end of tweezers 71. Regardless of which configuration is employed, the preferred construction for stabilizing member 90 comprises a substantially smooth, continuous outer surface which incorporates a smoothly rounded hand engaging edge 91 and two juxtaposed, spaced cooperating finger or palm engaging recesses 92, 92.

In the preferred embodiment, hand engaging edge 91 comprises a convexly shaped, smoothly curved configuration forming the rear end of stabilizing member 90. In addition, finger or palm engaging recesses 92, 92 comprise smoothly curved, concave shapes which form the two side edges of stabilizing member 90. In this way, by employing tweezers stabilizing member 90, an individual with impaired manual dexterity can easily and securely hold the distal end of the tweezers with assurance that the distal end thereof is secure and will not roll or twist during use.

If desired, tweezer stabilizing member 90 can be formed as part of control enhancing assembly 70. In this embodiment, distal end 79 of each tweezer-arm engaging member 72 and 73 would be constructed with a configuration substantially as shown and described above in reference to FIGS. 21 and 22. In this way, the resulting control enhancing construction would provide the user with both complete control over the movement of arms 75, 75 of tweezers 71 by employing the enlarged, finger engaging zones 82 formed thereon, as well as having complete securement and stability over movement of the distal end of the tweezers by use of the tweezer stabilizing component 90 formed as part thereof. In this way, all of the desired control and handling attributes sought by an individual with impaired manual dexterity are attained.

Another manicure implement which individuals having impaired manual dexterity have experienced difficulty in using is an emery board. In FIGS. 23–27, control enhancing member 94 of the present invention is clearly depicted for use with emery boards.

Figure 26:
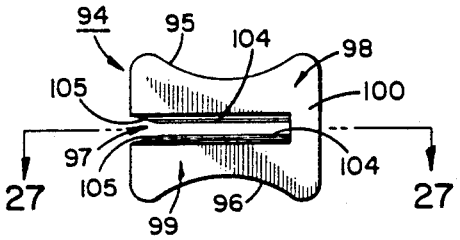
FIG. 26 is a front elevational view of the control enhancing system of FIG. 23.

Control enhancing member 94 comprises a substantially rectangular shape incorporating side wall portions 98 and 99 in juxtaposed, spaced relationship with each other. A centrally disposed elongated slot 97 is formed between side walls 98 and 99, longitudinally extending the entire width of member 94. In addition, slot 97 extends vertically through member 94 substantially more than midway, effectively defining the two juxtaposed, spaced, cooperating wall portions 98 and 99 and interconnecting bridge 100. As shown in FIG. 26, this construction of control enhancing member 94 establishes a substantially U-shape member, particularly evident when viewed from its front or rear end.

Figure 24:
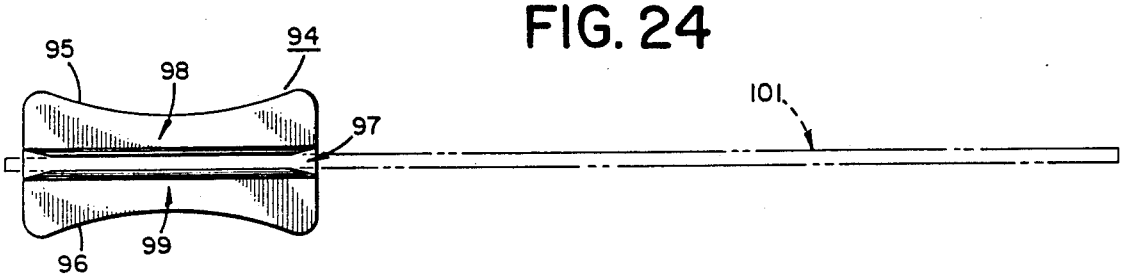
FIG. 24 is a top plan view of the control enhancing system of FIG. 23.
Figure 25:
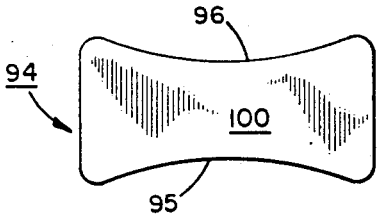
FIG. 25 is a bottom plan view of the control enhancing system of FIG. 23.

As best seen in FIGS. 24, 25 and 26, wall portion 98 comprises a finger/thumb receiving surface 95, while wall portion 99 comprises a finger/thumb receiving surface 96. Surfaces 95 and 96 are each preferably constructed to have an overall, substantially concave shape, thereby providing a surface which is readily accessible and comfortable for either the thumb or finger of the user.

In addition, slot 97, which is defined by side walls 98 and 99 of control enhancing member 94 is constructed with an overall width that is less than the thickness of emery board 101. In this way, emery board 101 is frictionally locked in engagement with walls 98 and 99 when board 101 is inserted into slot 97.

By employing this construction, the user is able to easily obtain a firm and secure grip on control enhancing member 94 by merely placing a thumb on either surface 95 or 96, and then placing any desired finger on the remaining finger/thumb receiving surface. Then, by merely holding wall portions 98 and 99, emery board 101 positioned within recess 97 is securely frictionally locked between walls 98 and 99. In this way, the user easily manipulates emery board 101 in the desired manner, achieving the desired controlled use thereof.

Figure 23:
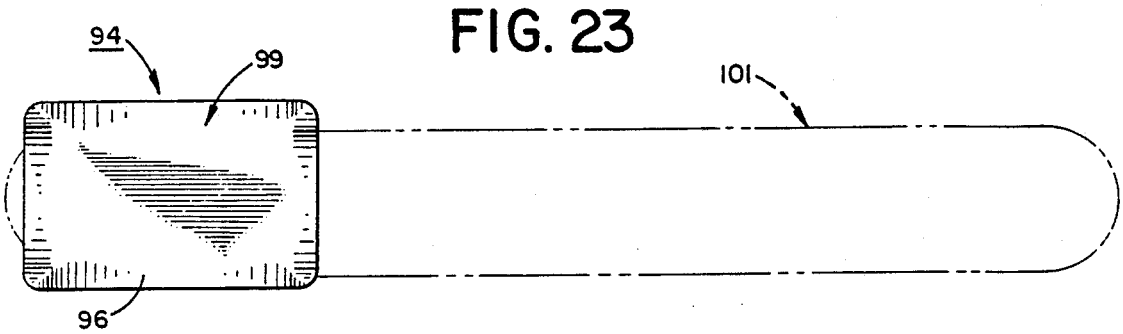
FIG. 23 is a side elevational view of a further alternate embodiment of the control enhancing system of the present invention for use with emery boards.

As shown in FIGS. 23 and 24, emery board 101 is positioned within recess 97 of control enhancing member 94 in order to allow the user to attain the desired controlled use of emery board 101. Although control enhancing member 94 is shown positioned at the distal end of emery board 101, control enhancing member 94 can be positioned at any location along the length of emery board 101, wherever most convenient for the user. In this way, complete control over any length of the emery board can be maintained as well as use of the entire emery board.

Figure 27:
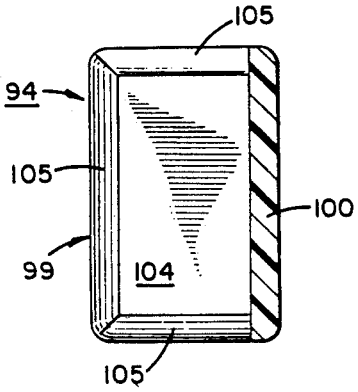
FIG. 27 is a cross-sectional side elevational view of the control enhancing system taken along line 27—27 of FIG. 26.

As best seen in FIG. 27, in order to provide the secure, locked engagement of emery board 101 with walls 98 and 99, emery board engaging surface 104 of side wall 99 is constructed to be substantially flat throughout its length and width. In this way, the surface area available to engage and hold emery board 101 is maximized. In addition, in order to assure operational ease in inserting emery board 101 in position, substantially flat, planar surface 104 is peripherally surrounded on its open sides by beveled edge 105. As shown in FIG. 26, wall portion 98 is also constructed in the identical manner as detailed above in reference to wall 99 with a planar surface 104 surrounded on three sides by beveled edge 105.

As a result of this construction, an enlarged entryway is provided by facing beveled portions 105, 105 providing a readily accessible zone for receiving the emery board 101, whether the emery board is inserted in the side of control enhancing member 94 or at the top thereof. In addition, once emery board 101 has been placed within slot 97 and in abutting engagement with bridge 100, emery board 101 is in securely locked frictional engagement with engaging surfaces 104, 104 of side walls 98 and 99.

Although it has been found that control enhancing member 94 is preferably constructed in the manner detailed above, alternate configurations for control enhancing member 94 can be employed without departing from the scope of the present invention. In particular, one alternate configuration would be to construct either side wall 98 or 99 with a substantially greater side-to-side width, in order to allow two or three fingers of the user to be positioned on the face thereof, thereby also establishing a substantially greater emery board engaging surface. Although it has been found that the configuration shown in FIGS. 23–27 provides secure locking engagement of emery boards for use by the individual, this alternate configuration, or any other similar alternate construction, could be made, if so desired, without departing from the scope of this invention.

In addition to the specific control and improving configurations detailed herein for the specific manicure implements or products, a plurality of alternate control improving members can be created for other similar products using the teaching of the present invention. Consequently, it is intended that all control improving configurations which incorporate the teaching of this invention shall be considered to be within the scope of protection afforded by this disclosure.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limited sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A control enhancing nail clipper constructed for substantially improving the handling characteristics and manipulation ease thereof by a user with reduced or impaired manual dexterity, said nail clipper comprising A. a base incorporating nail clipping means;

B. a lever arm mounted to the base for controlling the operation of the nail clipper means; and C. an arm engaging member mounted to the lever arm of the nail clipper, and incorporating a. a support base b. mounting means 1. extending from a first surface of the support base, and 2. constructed for lockingly engaging the lever arm and securely affixing the support base to the lever arm;

c. a finger/thumb receiving and supporting zone
1. formed on a second surface of the support base, and
2. constructed for comfortably and conveniently receiving the finger or thumb of the user and for securely positioning the finger/thumb in operational control over the lever arm of the nail clipper; and D. a base engaging member incorporating
a. a support base,
b. mounting means
1. extending from a first surface of the support base, and
2. constructed for lockingly engaging the base of the nail clipper and securely affixing the support base to the base of the nail clipper, and
c. a finger/thumb receiving and supporting zone
1. formed on a second surface of the support base, and
2. constructed for comfortably and conveniently receiving the finger or thumb of the user and for securely positioning the finger/thumb in operational control over the base of the nail clipper whereby users with impaired or reduced manual dexterity or with varying degrees of joint disease are capable of controllably operating the nail clipper by easily and readily accessing the finger/thumb receiving and support zones provided by the arm engaging members and the base engaging member.

2. The control enhancing system defined in claim 1, wherein said arm engaging member mounted to the lever arm is further defined as incorporating d. a pair of wall members
1. extending from opposed sides of the support base thereof in juxtaposed, spaced facing relationship, and
2. being spaced apart a distance substantially equal to the width of the lever arm, thereby providing a surrounding and embracing engaged relationship of the arm-engaging member with the lever arm.

3. The control enhancing system defined in claim 2, wherein the mounting means of the arm engaging member and the mounting means of the base engaging member are further defined as comprising a plurality of flanges extending from the respective wall members thereof for cooperating therewith and providing secure, locked engagement of the arm-engaging member with the lever arm and the base engaging member with the base of the nail clipper.

4. The control enhancing system defined in claim 3, wherein said flanges forming the locking means of the arm engaging member are further defined as extending from said wall portion thereof a sufficient distance to be in overlying locking engagement with the lever arm, while also being removably disconnectable from the nail clipper lever arm both longitudinally and laterally, thereby enabling complete removal of the arm-engaging member from the nail clipper when desired both easily and conveniently.

5. The control enhancing system defined in claim 3, wherein the arm engaging member is securely staked to the lever arm and the base engaging member is securely staked to the base of the nail clipper, thereby preventing complete removal of the arm engaging member and the base engaging member from the nail clipper.

6. The control enhancing system defined in claim 3, wherein said flanges forming the locking means of the base engaging member are further defined as extending from said wall portion thereof a sufficient distance to be in overlying locking engagement with the base, while also being removably disconnectable from the base both longitudinally and laterally, thereby enabling complete removal of the base engaging member from the nail clipper when desired both easily and conveniently.

7. The control enhancing system defined in claim 6, wherein said upstanding walls of the arm-engaging member and the base-engaging member are further defined as extending peripherally about the lever arm or the support base substantially enclosing three of the four sides thereof, whereby said wall members peripherally surrounds and encloses the side edges of the lever arm and base of the nail clipper, thereby preventing unwanted movement of the arm engaging member and the base engaging member relative to the nail clipper component to which each member is affixed.

8. The control enhancing system defined in claim 7, wherein the base engaging member is further defined as comprising a length substantially equal to the length of the nail clipper base, and said upstanding wall members are constructed for enclosing the sides of the nail clipper base, thereby substantially sealing the base of the nail clipper and providing a retaining zone.

9. The control enhancing system defined in claim 1, wherein each of said finger/thumb receiving and supporting zones of said members is further defined as comprising c. a substantially enlarged finger/thumb supporting surface positioned for easily and conveniently being accessed the user, and
d. an enlarged stop abutment positioned adjacent the finger/thumb supporting surface in smooth, blended, continuous cooperation therewith and comprising an upstanding wall portion for preventing unwanted movement or slippage of the user's finger/thumb on the supporting surface;

whereby the user, regardless of reduced or impaired manual dexterity, is able to easily and conveniently position a portion of the user's hand on the surfaces provided and controllably and conveniently operate the nail clippers with assurance that the user's operating fingers or thumb are securely positioned and free from unwanted slippage.

10. The control enhancing system defined in claim 1, wherein said arm engaging member mounted to the base is further defined as incorporating.

d. a pair of wall members
1. extending from opposed sides of the support base thereof in juxtaposed, spaced facing relationship, and
2. being spaced apart a distance substantially equal to the width of the base, thereby providing a surrounding and embracing engaged relationship of the base-engaging member with the base of the nail clipper.

11. A control enhancing nail clipper constructed for substantially improving handling characteristics and manipulation ease thereof by a user with reduced or impaired manual dexterity, said nail clipper comprising A. a base incorporating nail clipping means;
B. a lever arm mounted to the base for controlling the operation of the nail clipping means;

C. an arm engaging member mounted to the lever arm of the nail clipper, said arm engaging member incorporating
  a. a support base
  b. a pair of wall members
    1. extending from opposite sides of the support base thereof in juxtaposed, spaced facing relationship, and
    2. being spaced apart a distance substantially equal to the width of the lever arm,
  c. mounting means
    1. extending from a first surface of the support base,
    2. constructed for lockingly engaging the lever arm and securely affixing the support base to the lever arm, and
    3. comprising a plurality of flanges extending from the respective wall members thereof for cooperating therewith and providing secure, locked engagement of the arm-engaging member with the lever arm, and
  d. a finger-thumb receiving and supporting zone formed on a second surface of the support base and comprising
    1. a substantially enlarged finger/thumb supporting surface positioned for ease of access by the user and constructed for comfortably and conveniently receiving the finger or thumb of the user for securely positioning the finger/thumb in operational control over the lever arm of the nail clipper, and
    2. an enlarged stop abutment positioned adjacent the finger/thumb supporting surface in smooth, blended, continuous cooperation therewith and comprising an upstanding wall portion for preventing unwanted movement or slippage of the user's finger/thumb on the supporting surface; and D. a base engaging member mounted to the base of the nail clipper and incorporating
  a. a support base
  b. a pair of wall members
    1. extending from opposed sides of the support base thereof in juxtaposed, spaced facing relationship, and
    2. being spaced apart a distance substantially equal to the width of the nail clipper base,
  c. mounting means
    1. extending from a first surface of the support base,
    2. constructed for lockingly engaging the lever arm and securely affixing the support base to the nail clipper base, and
    3. comprising a plurality of flanges extending from the respective wall members thereof for cooperating therewith and providing secure, locked engagement of the base engaging member with the base of the nail clipper, and
  d. a finger/thumb receiving and supporting zone formed on a second surface of the support base and comprising
    1. a substantially enlarged finger/thumb supporting surface positioned for ease of access by the user and constructed for comfortably and conveniently receiving the finger or thumb of the user for securely positioning the finger/thumb in operational control over the base of the nail clipper, and
    2. an enlarged stop abutment positioned adjacent the finger/thumb supporting surface in smooth, blended, continuous cooperation therewith and comprising an upstanding wall portion for preventing unwanted movement or slippage of the user's finger/thumb on the supporting surface;

whereby users with impaired or reduced manual dexterity, or with varying stages of joint disease, are capable of controllably operating the nail clippers by readily accessing the finger/thumb receiving and supporting zones provided by the arm engaging member and the base engaging member.

12. A control enhancing nail clipper constructed for substantially improving the handling characteristics and manipulation ease thereof by users with reduced or impaired manual dexterity, said nail clipper comprising
  A. a base incorporating nail clipping means;
  B. a lever arm mounted to the base for controlling the operation of the nail clipping means;
  C. a first finger/thumb receiving and supporting zone formed on a surface of the lever arm and comprising
    a. a substantially enlarged finger/thumb supporting surface positioned for easily and conveniently being accessed by the user, and
    b. an enlarged stop abutment
      1. positioned adjacent the finger/thumb supporting surface in smooth, blended, continuous cooperation therewith, and
      2. comprising an upstanding wall portion for preventing unwanted movement or slippage of the user's finger/thumb from the supporting surface, thereby comfortably and conveniently receiving the finer or thumb of the user and securely positioning the finger/thumb in operational control over the lever arm of the nail clipper; and
  D. a second finger/thumb receiving and supporting zone formed on a surface of the base and comprising
    a. a substantially enlarged finger/thumb supporting surface positioned for easily and conveniently being accessed by the user, and
    b. an enlarged stop abutment
      1. positioned adjacent the finger/thumb supporting surface in smooth, blended, continuous cooperation therewith, and
      2. comprising an upstanding wall portion for preventing unwanted movement or slippage of the user's finger/thumb from the supporting surface, thereby comfortably and conveniently receiving the finger or thumb of the user and securely positioning the finger/thumb in operational control over the base of the nail clipper;

whereby users with impaired or reduced manual dexterity or with varying degrees of joint disease are capable of controllably operating the nail clipper by easily and readily accessing the finger/thumb receiving and support zones provided by the arm engaging members and the base engaging member.

* * * * *